US011802721B2

(12) United States Patent
Endou et al.

(10) Patent No.: US 11,802,721 B2
(45) Date of Patent: Oct. 31, 2023

(54) HEAT SOURCE UNIT AND SCROLL COMPRESSOR

(71) Applicant: DAIKIN INDUSTRIES, LTD., Osaka (JP)

(72) Inventors: Takeshi Endou, Osaka (JP); Yasuo Mizushima, Osaka (JP); Akira Mori, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/991,235

(22) Filed: Nov. 21, 2022

(65) Prior Publication Data

US 2023/0091714 A1 Mar. 23, 2023

Related U.S. Application Data

(63) Continuation of application No. PCT/JP2021/024166, filed on Jun. 25, 2021.

(30) Foreign Application Priority Data

Jul. 1, 2020 (JP) ..... 2020-114403
Jul. 1, 2020 (JP) ..... 2020-114404

(51) Int. Cl.
*F25B 31/00* (2006.01)
*F04C 2/02* (2006.01)

(52) U.S. Cl.
CPC ..... *F25B 31/00* (2013.01); *F04C 2/025* (2013.01); *F25B 2500/13* (2013.01)

(58) Field of Classification Search
CPC ..... F25B 31/00; F25B 2500/13; F25B 1/10; F25B 2400/07; F25B 2400/13; F04C 2/025
See application file for complete search history.

(56) References Cited

U.S. PATENT DOCUMENTS 5,137,437 A 8/1992 Machida et al.
6,234,211 B1 * 5/2001 Lepoutre ..... F16L 9/21 138/148

(Continued)

FOREIGN PATENT DOCUMENTS

DE 19606201 A1 * 8/1997 ..... F16L 3/223
JP 2865759 B2 3/1999

(Continued)

OTHER PUBLICATIONS

Pdf is translation of foreign reference DE 19606201 A1 (Year: 1997).*

(Continued)

*Primary Examiner* — Henry T Crenshaw
*Assistant Examiner* — Kamran Tavakoldavani
(74) *Attorney, Agent, or Firm* — Global IP Counselors, LLP

(57) ABSTRACT

A heat source unit of a refrigerant cycle apparatus includes a compressor, a pipe, and a fixing member. The compressor includes two or three connection portions of a first connection portion connecting a suction pipe, a second connection portion connecting a discharge pipe, and a third connection portion connecting an injection pipe. The pipe includes a vertical portion. At least a part of the vertical portion extends vertically from each of the two or three connection portions. The fixing member fixes at least two of the vertical portions of two or three of the pipes of the suction pipe, the discharge pipe, and the injection pipe. Each of the connection portions of the pipes fixed by the fixing member is located on a first straight line as seen in a top view.

15 Claims, 10 Drawing Sheets

(56) References Cited

U.S. PATENT DOCUMENTS

| | | | | |
|---|---|---|---|---|
| 2010/0037642 | A1* | 2/2010 | Shimoda | F04C 28/26 62/228.1 |
| 2014/0056727 | A1* | 2/2014 | Koyama | F04C 18/0215 417/228 |

FOREIGN PATENT DOCUMENTS

| | | | |
|---|---|---|---|
| JP | 2011-94914 | A | 5/2011 |
| JP | 2017-186924 | A | 10/2017 |
| JP | 2018-9543 | A | 1/2018 |

OTHER PUBLICATIONS

International Search Report of corresponding PCT Application No. PCT/JP2021/024166 dated Aug. 3, 2021.
International Preliminary Report of corresponding PCT Application No. PCT/JP2021/0024166 dated Jan. 12, 2023.

* cited by examiner

HEAT SOURCE UNIT AND SCROLL COMPRESSOR

CROSS-REFERENCE TO RELATED APPLICATIONS

This is a continuation of International Application No. PCT/JP2021/024166 filed on Jun. 25, 2021, which claims priority to Japanese Patent Application Nos. 2020-114403 and 2020-114404, filed on Jul. 1, 2020. The entire disclosures of these applications are incorporated by reference herein.

BACKGROUND

Technical Field

It relates to a heat source unit and a scroll compressor.

Background Art

A heat source unit such as an air conditioner includes a compressor. The compressor sucks a low-pressure gas refrigerant into a compression chamber of the compressor, compresses the low-pressure gas refrigerant into a high-pressure gas refrigerant, and discharges the high-pressure gas refrigerant. Therefore, a suction pipe and a discharge pipe are connected to the compression chamber of the compressor. Some compressors implement a technique called gas injection in order to improve performance of a refrigerant circuit. In the gas injection, a pipe called an injection pipe is connected to the compression chamber of the compressor.

The suction pipe, the discharge pipe, and the injection pipe often vibrate due to pressure pulsation of a gas refrigerant during operation. Therefore, noise may be generated or excessive stress may be applied. In addition, there is a risk of pipe breakage due to application of excessive force to these pipes by excitation during transportation. These cause a malfunction of devices. An air conditioner depicted in JP 2011-94914 A discloses a configuration of suppressing vibration during operation, but does not disclose a configuration of dealing with excitation applied during transportation.

SUMMARY

A heat source unit of a refrigerant cycle apparatus according to a first aspect includes a compressor, a pipe, and a fixing member. The compressor includes two or three connection portions of a first connection portion connecting a suction pipe, a second connection portion connecting a discharge pipe, and a third connection portion connecting an injection pipe. The pipe includes a vertical portion. At least a part of the vertical portion extends vertically from each of the two or three connection portions. The fixing member fixes at least two of the vertical portions of two or three of the pipes of the suction pipe, the discharge pipe, and the injection pipe. Each of the connection portions of the pipes fixed by the fixing member is located on a first straight line as seen in a top view.

DETAILED DESCRIPTION OF EMBODIMENT(S)

Hereinafter, an embodiment of the present disclosure will be described with reference to the drawings. The following embodiment specifically exemplifies the present disclosure and is not intended to limit the technical scope of the present disclosure.

(1) Outline of Refrigerant Cycle Apparatus Using Scroll Compressor

Figure 1:
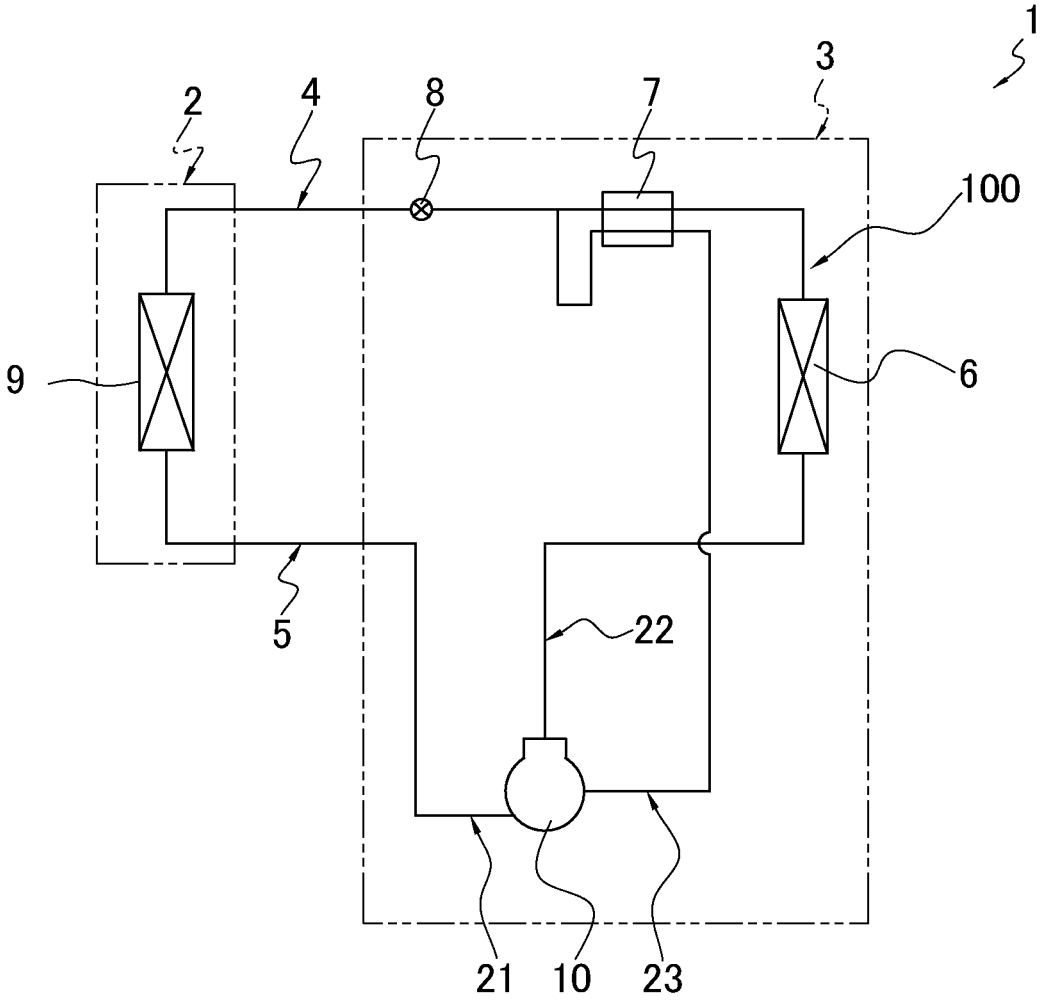
FIG. 1 is a refrigerant circuit diagram of a refrigerant cycle apparatus.

FIG. 1 is a refrigerant circuit diagram of a refrigerant cycle apparatus 1 using a scroll compressor 10 according to one embodiment of the present disclosure. Examples of the refrigerant cycle apparatus 1 employing the scroll compressor 10 include a "refrigerant cycle apparatus dedicated to cooling operation", a "refrigerant cycle apparatus dedicated to heating operation", and a "refrigerant cycle apparatus switchable to cooling operation or heating operation by using a four-way switching valve". Here, for convenience of description, description will be made with a "refrigerant cycle apparatus dedicated to cooling operation".

In FIG. 1, the refrigerant cycle apparatus 1 includes a utilization unit 2 and a heat source unit 3, and the utilization unit 2 and the heat source unit 3 are connected to each other by a liquid refrigerant connection pipe 4 and a gas refrigerant connection pipe 5. As illustrated in FIG. 1, the refrigerant cycle apparatus 1 is of a separate type including one utilization unit 2 and one heat source unit 3. However, the present disclosure is not limited thereto. Alternatively, the refrigerant cycle apparatus 1 may be of a multi-type including a plurality of utilization units 2.

In the refrigerant cycle apparatus 1, devices such as the scroll compressor 10, an outdoor heat exchanger 6, an economizer heat exchanger 7, an expansion valve 8, and an indoor heat exchanger 9 are connected by pipes to constitute a refrigerant circuit 100.

(1-1) Utilization Unit

The indoor heat exchanger 9 mounted on the utilization unit 2 is a cross-fin type fin-and-tube heat exchanger including a heat transfer tube and a large number of heat transfer fins. The indoor heat exchanger 9 has a liquid side connected to the liquid refrigerant connection pipe 4 and a gas side connected to the gas refrigerant connection pipe 5, and functions as an evaporator for refrigerant.

(1-2) Heat Source Unit 3

The heat source unit 3 is equipped with the scroll compressor 10, the outdoor heat exchanger 6, the economizer heat exchanger 7, the expansion valve 8, and the like. The scroll compressor 10 will be described in detail later.

(1-2-1) Outdoor Heat Exchanger

The outdoor heat exchanger 6 is a cross-fin type fin-and-tube heat exchanger including a heat transfer tube and a large number of heat transfer fins. One side of the outdoor heat exchanger 6 is connected to a discharge pipe 22 through which the refrigerant discharged from the scroll compressor 10 flows, and the other side of the outdoor heat exchanger 6 is connected to a suction pipe 21. The outdoor heat exchanger 6 functions as a condenser for a gas refrigerant supplied from the scroll compressor 10 via the discharge pipe 22.

(1-2-2) Economizer Heat Exchanger

As shown in FIG. 1, the economizer heat exchanger 7 is disposed between the outdoor heat exchanger 6 and the expansion valve 8. The economizer heat exchanger 7 causes heat exchange between the refrigerant flowing from the outdoor heat exchanger 6 toward the expansion valve 8 and the refrigerant flowing through an injection pipe 23.

(1-2-3) Expansion Valve

The expansion valve 8 is provided on a pipe connecting the outdoor heat exchanger 6 and the liquid refrigerant connection pipe 4. The expansion valve 8 is an electric valve whose opening degree is adjustable for adjusting a pressure and a flow rate of the refrigerant flowing through the pipe.

(2) Detailed Configuration of Scroll Compressor

Figure 2:
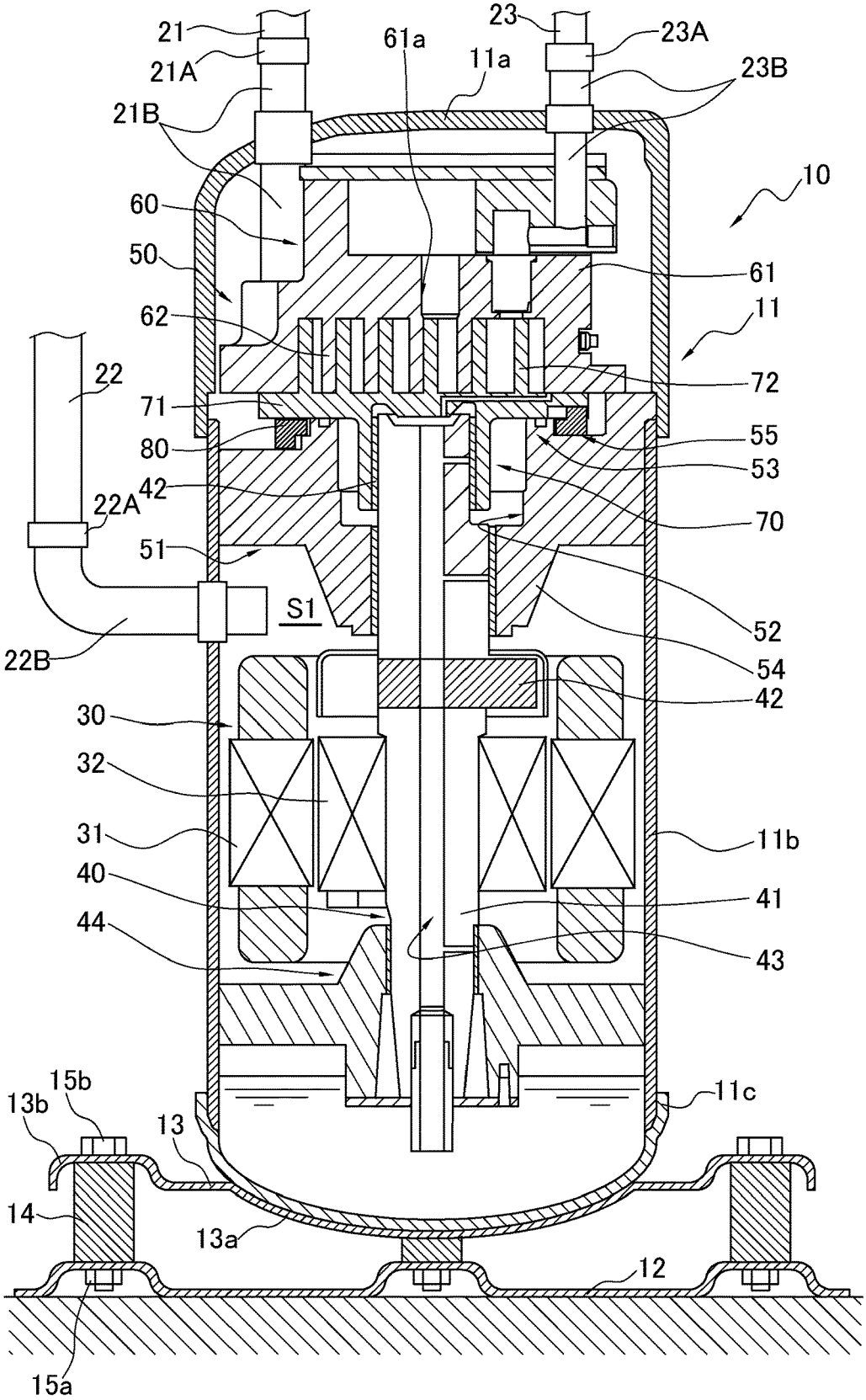
FIG. 2 is a longitudinal sectional view of a scroll compressor.
Figure 3:
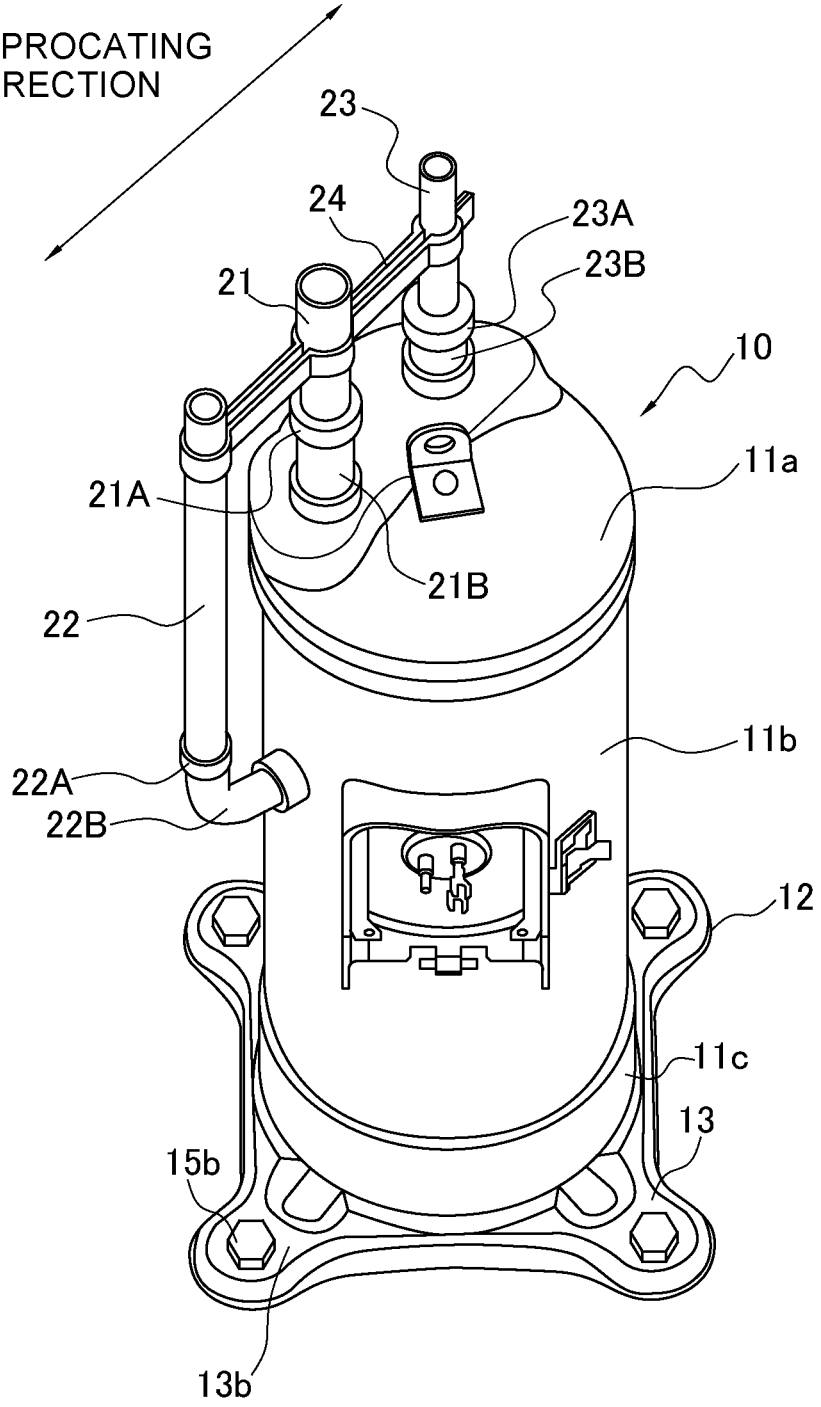
FIG. 3 is a schematic view of the scroll compressor.
Figure 4:
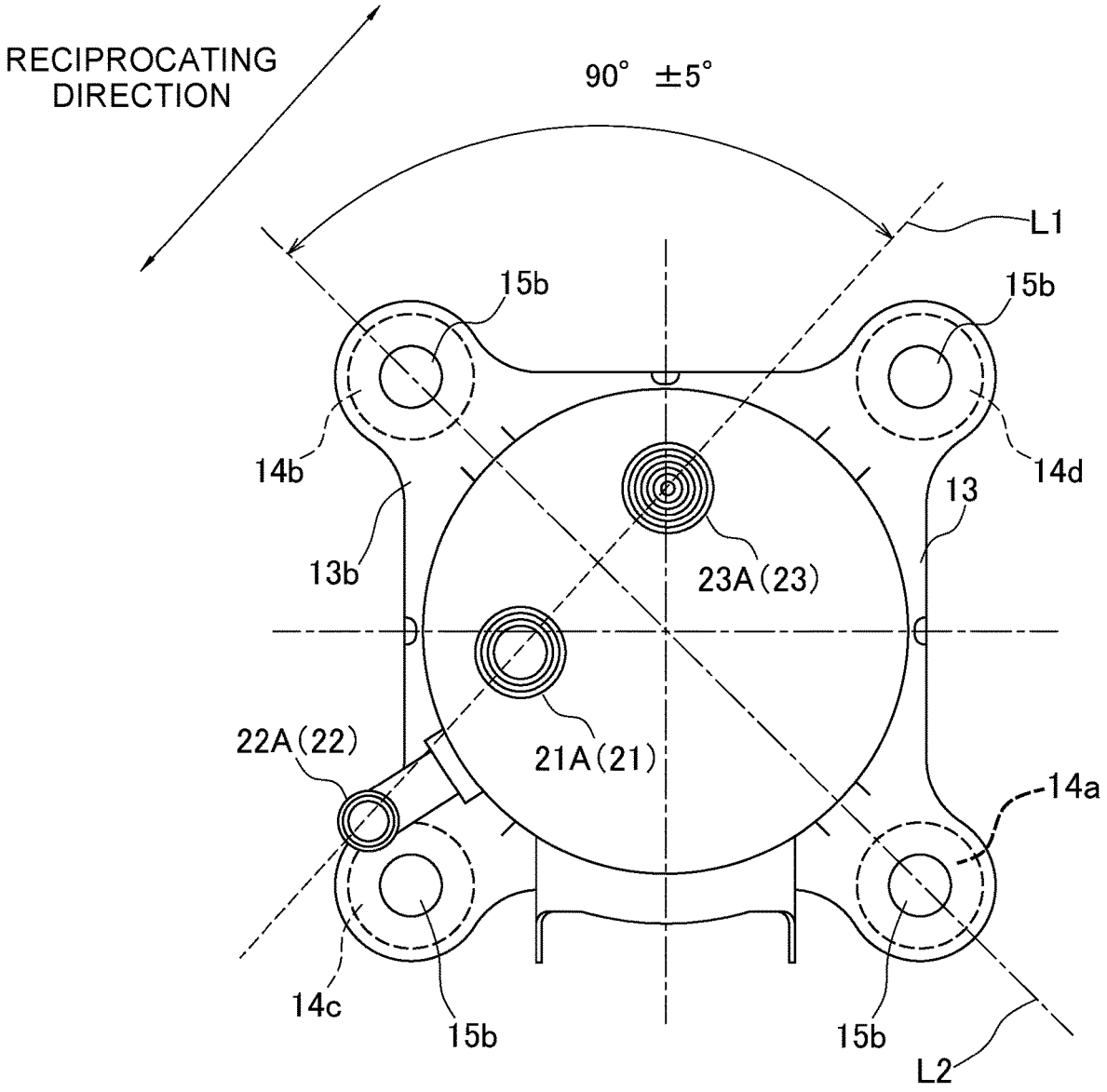
FIG. 4 is a schematic view of the scroll compressor.

FIG. 2 is a longitudinal sectional view of the scroll compressor 10 according to one embodiment of the present disclosure. FIG. 3 is a schematic view showing appearance of the scroll compressor 10. FIG. 4 is a schematic top view of the scroll compressor 10. The scroll compressor 10 according to one embodiment of the present disclosure is a so-called all-hermetic compressor, is connected to the refrigerant circuit 100 that performs a refrigeration cycle, and sucks and compresses a refrigerant in the refrigerant circuit 100. The scroll compressor 10 is fixed to a bottom plate 12 of the heat source unit 3.

In the scroll compressor 10, a scroll compression mechanism 50 as a body mechanism, an electric motor 30, a lower bearing member 44, and a drive shaft 40 as a rotary shaft are accommodated in an internal space of a casing 11.

(2-1) Casing, Suction Pipe, Discharge Pipe, and Injection Pipe

The casing 11 is a sealed container having a vertically long cylindrical shape. In the internal space of the casing 11, the scroll compression mechanism 50, the electric motor 30, and the lower bearing member 44 are disposed in order from top to bottom. The drive shaft 40 is disposed such that its axial direction is along a height direction of the casing 11. A detailed structure of the scroll compression mechanism 50 will be described later.

As illustrated in FIG. 3, the suction pipe 21, the discharge pipe 22, and the injection pipe 23 are attached to the casing 11 as pipes. The suction pipe 21 is connected via a first connection portion 21A to a first vertical portion 21B which is a vertically extending portion of the suction pipe 21. A part of the first vertical portion 21B is welded and fixed to an upper lid 11*a* of the casing 11. A lower end of the first vertical portion 21B is connected to a fixed scroll 60 of the scroll compression mechanism 50. The suction pipe 21 communicates with a compression chamber Sc of the scroll compression mechanism 50 via the first vertical portion 21B. A low-pressure refrigerant in the refrigeration cycle before being compressed by the scroll compressor 10 flows through the suction pipe 21 and the first vertical portion 21B.

The discharge pipe 22 is connected via a second connection portion 22A to a second vertical portion 22B which is a vertically extending portion of the discharge pipe 22. A part of the second vertical portion 22B is welded and fixed to a cylindrical member 11*b* of the casing 11. The second vertical portion 22B is disposed so that an end of the second vertical portion 22B inside the casing 11 protrudes into a high-pressure space S1 formed below a bearing housing 51 of the scroll compression mechanism 50. A high-pressure refrigerant in the refrigeration cycle after being compressed by the scroll compression mechanism 50 flows through the discharge pipe 22 and the second vertical portion 22B.

The injection pipe 23 is connected via a third connection portion 23A to a third vertical portion 23B which is a vertically extending portion of the injection pipe 23. A part of the third vertical portion 23B is welded and fixed to the upper lid 11*a* of the casing 11. An end of the third vertical portion 23B inside the casing 11 is connected to the fixed scroll 60, and the third vertical portion 23B supplies the refrigerant to an injection passage formed in the fixed scroll 60. The injection passage communicates with the compression chamber Sc of the scroll compression mechanism 50, and the refrigerant supplied from the third vertical portion 23B is supplied to the compression chamber Sc as a pressure in a middle (intermediate pressure) between a low pressure and a high pressure in the refrigeration cycle.

In the scroll compressor 10 according to the present embodiment, as illustrated in FIGS. 2 and 3, the first vertical portion 21B, the second vertical portion 22B, and the third vertical portion 23B include a coupling pipe fixed to the casing 11 and pipes inside and outside the casing 11 inserted into the coupling pipe.

As illustrated in FIG. 4, in top view, the connection portions 21A, 22A, and 23A of the pipes 21, 22, and 23 are disposed so as to be located on one first straight line L1. The pipes 21, 22, and 23 extending from the connection portions 21A, 22A, and 23A located on the first straight line L1 have the vertical portions 21B, 22B, and 23B fixed by a fixing member 24.

Specifically, as illustrated in FIG. 4, in a top view of an end connecting the connection portions 21A, 22A, and 23A and the pipes 21, 22, and 23, the first straight line L1 is preferably a substantially straight line that connects centers of the connection portions. However, the first straight line L1 may be slightly bent as long as rigid body vibration of the scroll compressor 10 can be suppressed. The pipes 21, 22, and 23 are disposed so that an angle formed by the first straight line L1 and a reciprocating direction of an Oldham coupling 80 described later is 10° or less. The angle may be slightly shifted as long as the pipes 21, 22, and 23 can suppress rigid body vibration of the scroll compressor 10.

The pipe fixing member 24 fixes parts of the pipes 21, 22, and 23 vertically extending from the connection portions 21A, 22A, and 23A to each other. The pipe fixing member 24 may be, for example, a metal such as iron, and may be, for example, a sheet-metal member formed to surround each of the pipes 21, 22, and 23 in a circumferential direction as illustrated in FIG. 3. The pipe fixing member 24 may include a vibration reducing member for reducing vibration between the pipe fixing member 24 and each of the pipes 21, 22, and 23. This structure can reduce vibration applied to the scroll compression mechanism 50. Details will be described later.

(2-2) Support Bracket and Vibration-Proof Rubber

A support bracket 13 for fixing the casing 11 to the bottom plate 12 of an outdoor unit is provided below the casing 11. The support bracket 13 includes an attachment portion 13*a* attached to a bottom of the casing 11 to support the casing 11 from below, and a support leg (leg) 13*b* fixed to the bottom plate 12 via a vibration-proof rubber 14. The attachment portion 13*a* and the support leg 13*b* are formed integrally. Four support legs 13*b* are provided apart from each another in a circumferential direction of the casing 11.

A part of the bottom plate 12 protrudes upward, and the vibration-proof rubber 14 is installed on the protrusion of the bottom plate 12. The vibration-proof rubber 14 includes a cylindrical rubber material extending in an up-down direction. A fastening nut 15*a* is welded to the bottom plate 12.

By inserting the fastening bolt 15*b* from above the support bracket 13 and fastening the fastening bolt 15*b* to the fastening nut 15*a*, the casing 11 is fixed to the bottom plate 12 in a state where the vibration-proof rubber 14 is sandwiched between each of the support legs 13*b* of the casing 11 and the bottom plate 12.

At least one (here, vibration-proof rubbers 14*a* and 14*b*) of the four vibration-proof rubbers 14 respectively attached to the support legs 13*b* is attached so as to exist on a second straight line L2 that passes through a center of the cylindrical member 11*b* of the casing 11, is orthogonal to the first straight line L1 connecting the pipes 21, 22, and 23 as illustrated in FIG. 4. Here, orthogonal means that the second straight line L2 is preferably at an angle of 90°±5° with respect to the first straight line L1. The angle may be slightly shifted as long as the rigid body vibration of the scroll compressor 10 can be suppressed. One vibration-proof rubber 14*a* of the vibration-proof rubbers 14*a* and 14*b* is located at a position farthest from the first straight line L1 than the other three vibration-proof rubbers 14*b*, 14*c*, and 14*d*, and can efficiently reduce vibration applied to the scroll compression mechanism 50. Therefore, the vibration-proof rubber 14*a* is preferably include a material having a higher spring constant than the other three vibration-proof rubbers 14*b*, 14*c*, and 14*d*.

(2-3) Electric Motor

The electric motor 30 includes a stator 31 and a rotor 32. The stator 31 is fixed to the casing 11. The rotor 32 is disposed coaxially with the stator 31. Into the rotor 31, a main shaft 41 of the drive shaft 40 is inserted.

(2-4) Drive Shaft

The drive shaft 40 is provided with the main shaft 41 and an eccentric portion 42. A lower part of the main shaft 41 penetrates the rotor 32 of the electric motor 30. The eccentric portion 42 has a columnar shape with a diameter smaller than the main shaft 41, and protrudes from an upper end surface of the main shaft 41. The eccentric portion 42 has an axis that is eccentric relative to an axis of the main shaft 41.

An oil supply passage 43 penetrating in the up-down direction is formed in the drive shaft 40. A refrigerating machine oil as a lubricating oil is stored at the bottom of the casing 11. When the drive shaft 40 rotates, the refrigerating machine oil stored at the bottom of the casing 11 is sucked up to the oil supply passage 43 and supplied to a sliding portion of the lower bearing member 44 and the scroll compression mechanism 50.

(2-5) Scroll Compression Mechanism

The scroll compression mechanism 50 includes the bearing housing 51, the fixed scroll 60, a movable scroll 70, and the Oldham coupling 80. In the scroll compression mechanism 50, the compression chamber Sc as a fluid chamber is formed by the fixed scroll 60 and the movable scroll 70. The Oldham coupling 80 is a member to restrict rotation of the movable scroll 70.

(2-5-1) Bearing Housing

The bearing housing 51 has a thick disc shape, and has an outer peripheral edge fixed to the casing 11. A central recess 52 and an annular projection 53 are formed at a center of the bearing housing 51. The central recess 52 is a circular pit that opens to an upper surface of the bearing housing 51. The annular projection 53 is formed along an outer periphery of the central recess 52 and protrudes from the upper surface of the bearing housing 51. An end surface of the annular projection 53 is a flat surface.

On the bearing housing 51, a central protrusion 54 is formed. The central protrusion 54 is located below the central recess 52 and protrudes downward. A through hole penetrating the central protrusion 54 in the up-down direction is formed in the central protrusion 54, and the main shaft 41 of the drive shaft 40 is inserted through the through hole to rotatably support the drive shaft 40.

Figure 5A:
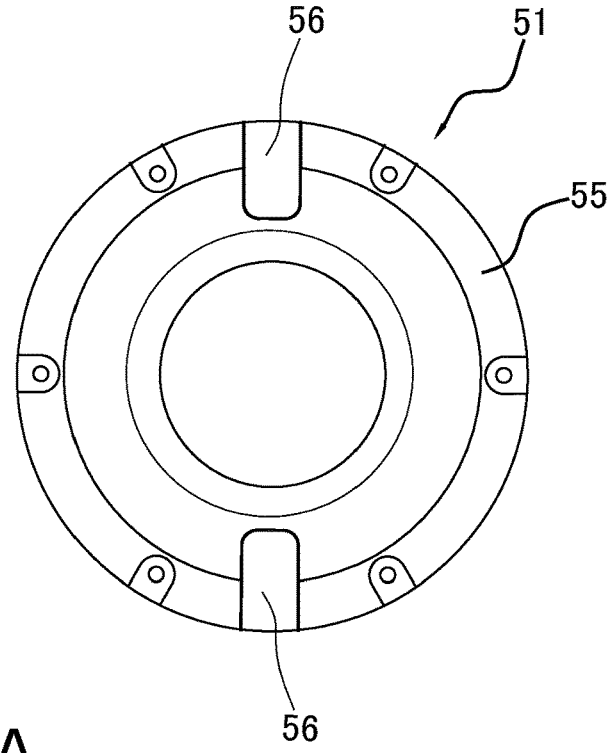
FIG. 5A is a schematic view of a bearing housing.

A part of the upper surface of the bearing housing 51 outside the annular projection 53 is a flat surface 55. As illustrated in FIG. 5A, the bearing housing 51 is provided with two fixed-side key grooves 56 that open to the flat surface 55.

The fixed-side key grooves 56 are elongated grooves extending along a straight line orthogonal to a center axis of the main shaft 41 of the drive shaft 40. The two fixed-side key grooves 56 are located opposite to each other across the center axis of the main shaft 41 of the drive shaft 40. Fixed-side keys 82 of the Oldham coupling 80 are engaged with the fixed-side key grooves 56.

As illustrated in FIG. 2, the fixed scroll 60 and the movable scroll 70 are placed on the bearing housing 51. The fixed scroll 60 is fixed to the bearing housing 51 with a bolt or the like. On the other hand, the movable scroll 70 is driven by the drive shaft 40 to revolve.

(2-5-2) Fixed Scroll

The fixed scroll 60 is a member in which a fixed-side end plate 61 and a fixed-side lap 62 are integrally formed. The fixed-side end plate 61 has a disc shape. The fixed-side lap 62 has a spiral wall shape and is provided on a lower surface of the fixed-side end plate 61. The fixed scroll 60 is a member in which a fixed scroll substrate 61 and a fixed-side lap 62 extending downward in a spiral shape from the lower surface of the fixed scroll substrate 61 are integrally formed.

In the fixed-side end plate 61, a discharge port 61*a* is formed. The discharge port 61*a* is a through hole formed near a center of the fixed-side end plate 61, and penetrates the fixed-side end plate 61 in a thickness direction. The first vertical portion 21B is inserted near an outer periphery of the fixed-side end plate 61.

(2-5-3) Movable Scroll

Figure 5B:
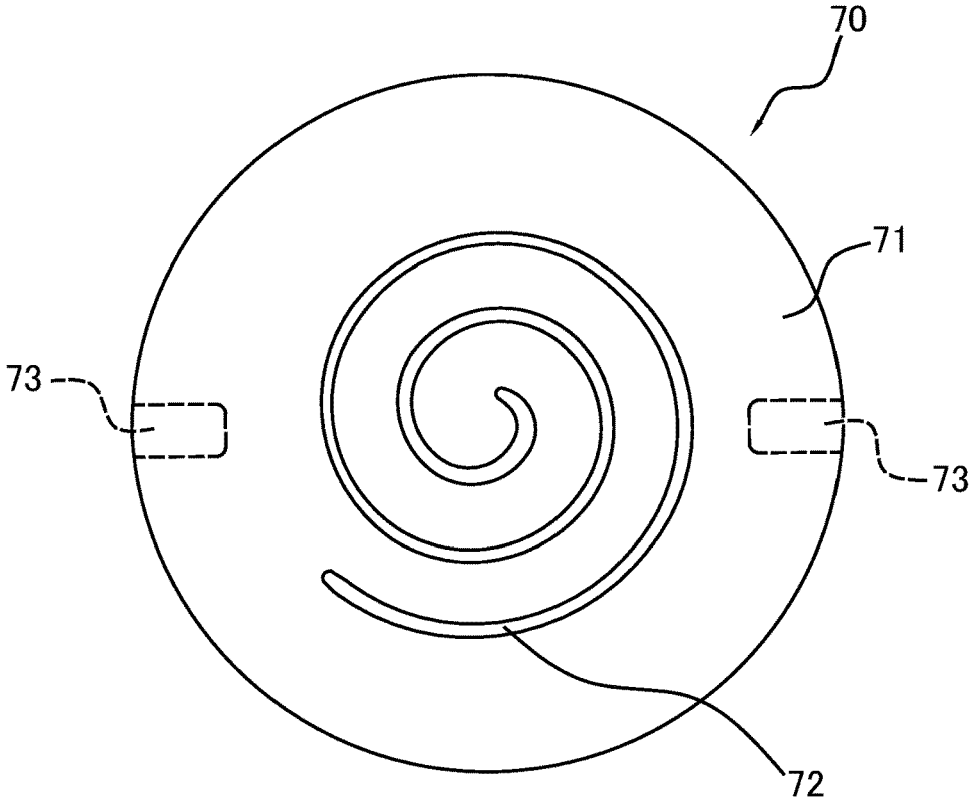
FIG. 5B is a schematic view of a movable scroll.

The movable scroll 70 illustrated in FIG. 5B is a member in which a movable-side end plate 71 and a movable-side lap 72 are integrally formed. The movable-side end plate 71 has a disc shape. The movable-side lap 72 has a spiral wall shape and protrudes from an upper surface of the movable-side end plate 71.

In the movable scroll 70, two movable-side key grooves 73 that open to a lower surface of the movable-side end plate 71 are formed. Movable-side keys 81 of the Oldham coupling 80 are engaged with the movable-side key grooves 73.

In the scroll compression mechanism 50, the fixed scroll 60 and the movable scroll 70 are disposed so that the lower surface of the fixed-side end plate 61 and the upper surface of the movable-side end plate 71 face each other, and the fixed-side lap 62 and the movable-side lap 72 mesh with each other. In the scroll compression mechanism 50, the fixed-side lap 62 and the movable-side lap 72 mesh with each other to form a plurality of compression chambers Sc.

(2-5-4) Oldham Coupling

Figure 6A:
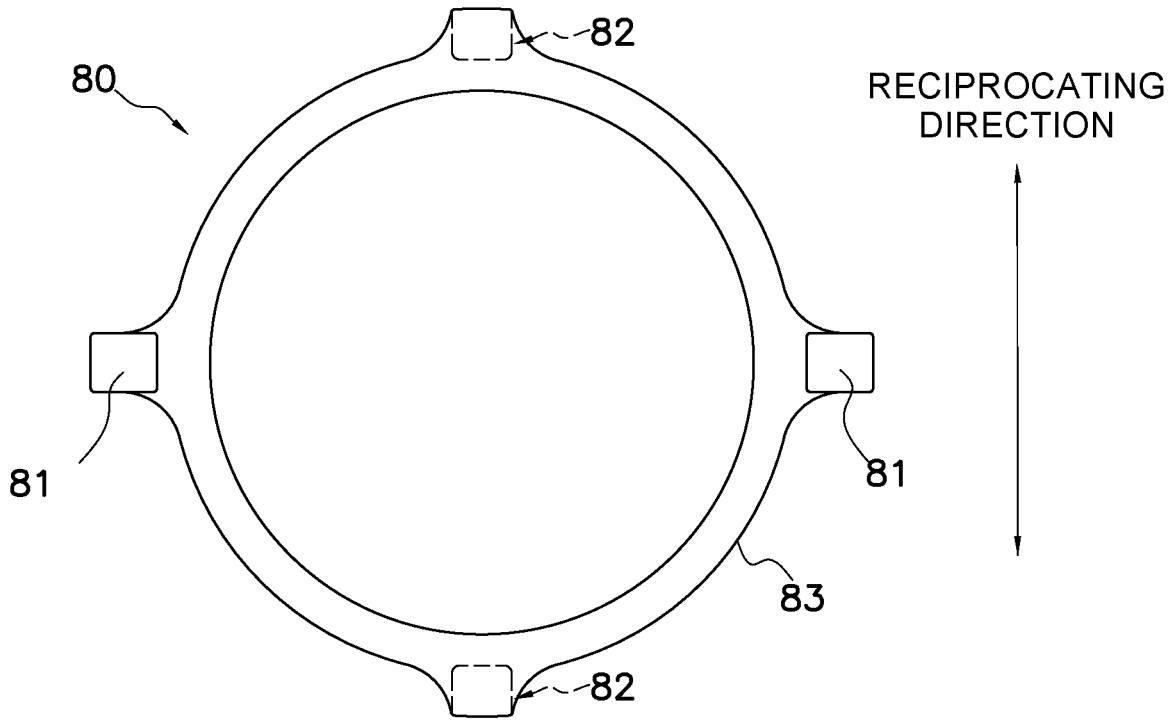
FIG. 6A is a schematic view of an Oldham ring.
Figure 6B:
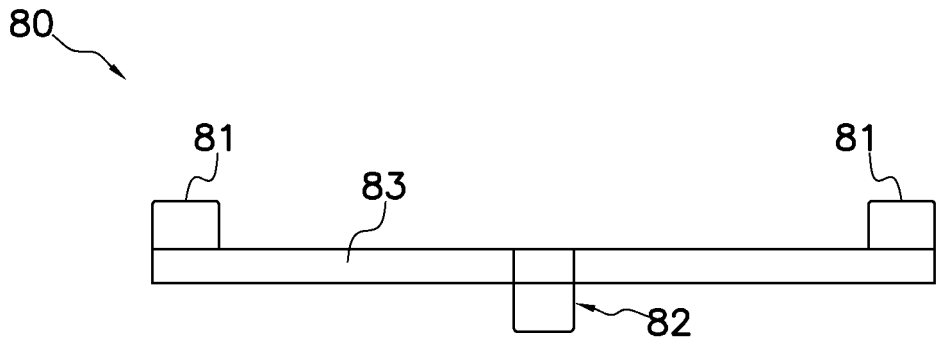
FIG. 6B is a schematic view of the Oldham ring.

As illustrated in FIGS. 6A and 6B, the Oldham coupling 80 includes one ring 83, two movable-side keys 81, and two fixed-side keys 82. The ring 83 has a rectangular cross section. The ring portion 83 has a thickness that is constant over an entire circumference of the ring 83. The ring 83 has an upper surface and a lower surface that are flat surfaces parallel to each other. The movable-side keys 81 are located above the upper surface of the ring 83. The fixed-side keys 82 are located below the lower surface of the ring 83. Here, the two movable-side keys 81 and the two fixed-side keys 82 are arranged at substantially equally spaced apart from each another in a circumferential direction, but there are numerous variations in the number and arrangement of the keys. Here, the two movable side keys 81 are disposed on opposite to each other across a center of the ring 83. The two fixed-side keys 82 are disposed on opposite to each other across the center of the ring 83.

As illustrated in FIG. 2, the Oldham coupling 80 is disposed between the movable-side end plate 71 of the movable scroll 70 and the bearing housing 51. In the scroll compression mechanism 50 in operation, the movable-side keys 81 of the Oldham coupling 80 are in sliding contact with inner surfaces of the movable-side key grooves 73 of the movable scroll 70. The fixed-side keys 82 of the Oldham coupling 80 are in sliding contact with inner surfaces of the fixed-side key grooves 56 of the bearing housing 51. Therefore, the Oldham coupling 80 serves to allow the movable scroll 70 to revolve with respect to the bearing housing 51 and prevent the movable scroll 70 from rotating with respect to the bearing housing 51. In other words, the Oldham coupling 80 slides on both the bearing housing 51 and the movable scroll 70, and thus the movable scroll 70 revolves without rotating with respect to the fixed scroll 60 fixed to the bearing housing 51.

(3) Operation and Motion

Hereinafter, operation and motion of the scroll compressor 10 will be described. In the scroll compressor 10, when the movable scroll 70 revolves, a low-pressure gas refrigerant flowing into the scroll compression mechanism 50 through the suction pipe 21 is sucked into the compression chamber Sc from around the outer peripheral ends of the fixed-side lap 62 and the movable-side lap 72. When the movable scroll 70 further moves, the compression chamber Sc is blocked from the suction pipe 21 to be in a closed state, and thereafter, the compression chamber Sc moves along the fixed-side lap 62 and the movable-side lap 72 toward inner peripheral ends of the fixed-side lap 62 and the movable-side lap 72. In this process, a volume of the compression chamber Sc gradually decreases, and the gas refrigerant in the compression chamber Sc is compressed.

When the volume of the compression chamber Sc gradually decreases as the movable scroll 70 moves, the compression chamber Sc eventually communicates with the discharge port 61*a*. The refrigerant compressed in the compression chamber Sc (that is, a high-pressure gas refrigerant) flows into a discharge gas passage through the discharge port 61*a*, and is then discharged to a portion between the scroll compression mechanism 50 and the electric motor 30 in the internal space of the casing 11. The high-pressure gas refrigerant discharged into the internal space of the casing 11 flows out of the casing 11 through the discharge pipe 22.

A refrigerating machine oil as a lubricating oil is stored in the internal space of the casing 11. The pressure of the refrigerating machine oil stored in the casing 11 is substantially equal to a pressure of the gas refrigerant discharged from the scroll compression mechanism 50. While the scroll compressor 10 is operating, the drive shaft 40 rotates, the refrigerating machine oil stored at the bottom of the casing 11 is sucked up to the oil supply passage 43 and supplied to the sliding portion of the lower bearing member 44 and the scroll compression mechanism 50.

(4) Characteristics (4-1)

The heat source unit 3 of the refrigerant cycle apparatus 1 of the present disclosure includes the compressor 10, pipes, and the fixing member 24. The compressor 10 has two or three connection portions among the first connection portion 21A, the second connection portion 22B, and the third connection portion 23A. The compressor 10 includes the casing 11 and three or four legs 13*b* provided below the casing 11. The vibration-proof rubber 14 is attached to each of the three or four legs 13*b*. The first connection portion 21A connects the suction pipe 21. The second connection portion 22A connects the discharge pipe 22. The third connection portion 23A connects the injection pipe 23. Each of the pipes has a vertical portion. The vertical portion is a portion at least a part of which extends vertically from each of the two or three connection portions. The vertical portion extending from the first connection portion 21A is the first vertical portion 21B. The vertical portion extending from the second connection portion 22A is the first vertical portion 22B. The vertical portion extending from the third connection portion 23A is the third vertical portion 23B. The fixing member 23 fixes at least two of the two or three pipes to each other at the vertical portions. The fixing member 23 includes a metal. In top view, each of the connection portions of the pipes fixed by the fixing member 23 is located on one first straight line L1. At least one leg 13*b* exists on the second straight line L2 passing through the center of the casing 11 and orthogonal to the first straight line L1 in top view.

In the compressor 10 of the heat source unit 3, when the electric motor 30 is energized, the drive shaft 40 drives the movable scroll 70. The movable scroll 70 is restricted from rotating by the Oldham coupling 80 and does not rotate but revolves.

At this time, in the Oldham coupling 80, the fixed-side keys 82 reciprocate in the arrow direction in FIG. 6A along the fixed-side key grooves 56. Then, due to an influence of an inertial force due to the reciprocating motion of the Oldham coupling 80, an excitation force in a reciprocating direction of the Oldham coupling 80 increases. Therefore, vibration due to an unbalanced inertial force of the Oldham coupling 80 is transmitted to the casing 11, and the rigid body vibration of the scroll compressor 10 increases.

In the present embodiment, by fixing the pipes 21, 22, and 23 to each other by the same pipe fixing member in a state of being disposed along the first straight line, it is possible to increase support rigidity in the reciprocating direction of the Oldham coupling 80 and to suppress the rigid body vibration of the scroll compressor 10 effectively. As a result, stress applied to each pipe due to vibration can be suppressed, a risk of pipe breakage or the like can be reduced, and reliability of the scroll compressor 10 can be enhanced. In addition, this configuration is intended to reduce the risk without increasing a production cost of the scroll compressor 10.

(4-2)

The scroll compressor 10 of the present disclosure includes two or three connection portions among the first connection portion 21A, the second connection portion 22A, and the third connection portion 23A, and the scroll compression mechanism 50. The first connection portion 21A connects the suction pipe 21. The second connection portion 22A connects the discharge pipe 22. The third connection portion 23A connects the injection pipe 23. The scroll compression mechanism 50 includes the fixed scroll 60, the movable scroll 70, and the Oldham coupling 80. The fixing member 24 fixes two or three pipes among the suction pipe 21, the discharge pipe 22, and the injection pipe 23. In the scroll compressor 10, an angle formed between a first direction in which the pipe fixing member 24 extends in top view and the reciprocating direction of the Oldham coupling 80 is 10° or less.

In the scroll compressor 10, when the electric motor 30 is energized, the drive shaft 40 drives the movable scroll 70. The movable scroll 70 is restricted from rotating by the Oldham coupling 80 and does not rotate but revolves.

At this time, in the Oldham coupling 80, the fixed-side keys 82 reciprocate in the arrow direction in FIG. 6A along the fixed-side key grooves 56. Then, due to an influence of an inertial force due to the reciprocating motion of the Oldham coupling 80, an excitation force in a reciprocating direction of the Oldham coupling 80 increases. Therefore, vibration due to an unbalanced inertial force of the Oldham coupling 80 is transmitted to the casing 11, and the rigid body vibration of the scroll compressor 10 increases.

In the present embodiment, by fixing the pipes 21, 22, and 23 to each other by the same pipe fixing member in a state of being disposed along the first straight line, it is possible to increase support rigidity in the reciprocating direction of the Oldham coupling 80 and to suppress the rigid body vibration of the scroll compressor 10 effectively. As a result, stress applied to each pipe due to vibration can be suppressed, a risk of pipe breakage or the like can be reduced, and reliability of the scroll compressor 10 can be enhanced. In addition, this configuration is intended to reduce the risk without increasing a production cost of the scroll compressor 10.

(4-3)

The heat source unit 3 of the refrigerant cycle apparatus 1 of the present disclosure includes the scroll compressor 10 configured as described above, the suction pipe 21, the discharge pipe 22, the injection pipe 23, and the pipe fixing member 24. The suction pipe 21 has the first vertical portion 21B connected to the first connection portion 21A. The discharge pipe 22 has the second vertical portion 22B connected to the second connection portion 22A. The injection pipe 23 has the third vertical portion 23B connected to the third connection portion 23A. The pipe fixing member 24 fixes two or three pipes among the suction pipe 21, the discharge pipe 22, and the injection pipe 23. In the present embodiment, the pipe fixing member 24 fixes the suction pipe 21, the discharge pipe 22, and the injection pipe 23. The pipe fixing member 24 is metal.

The heat source unit 3 configured as described above can effectively suppress rigid body vibration of the scroll compressor 10 and improve reliability of the scroll compressor 10. In addition, the pipe fixing member 24 can more effectively suppress the rigid body vibration by preferably fixing the three pipes among the suction pipe 21, the discharge pipe 22, and the injection pipe 23. By using a metal member having high strength as the pipe fixing member 24, deformation or the like of the pipe fixing member 24 can be suppressed, and the reliability of the heat source unit 3 can be further enhanced.

(5) Modifications (5-1) Modification 1

Figure 7:
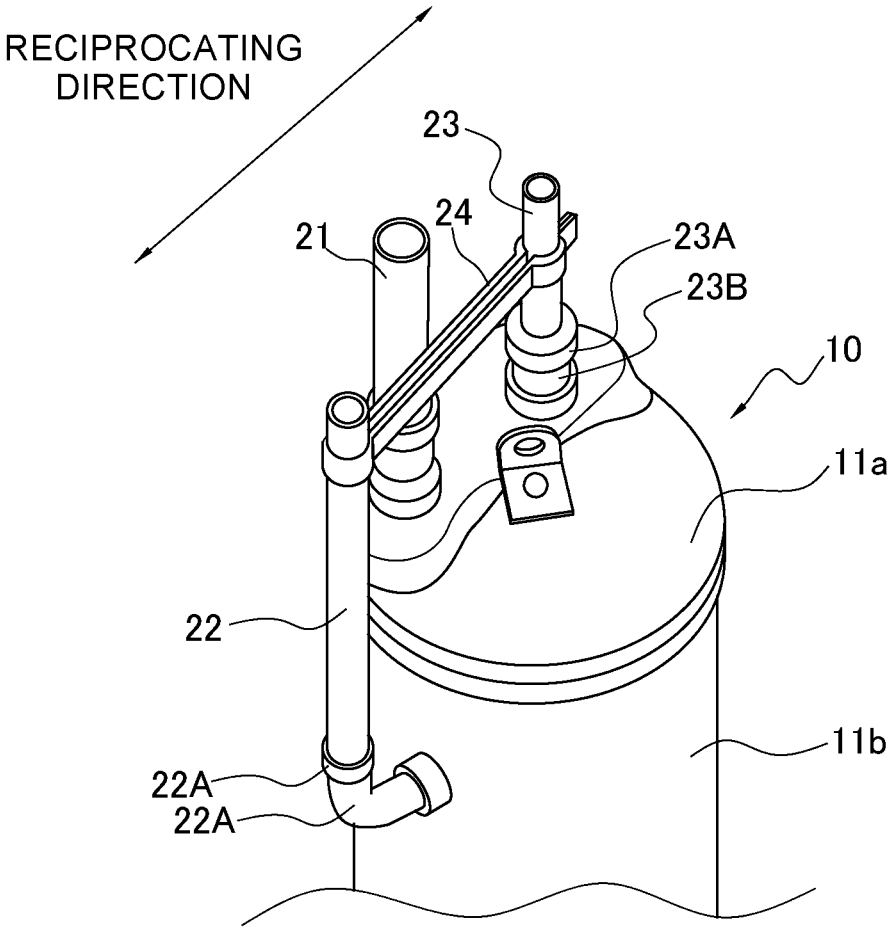
FIG. 7 is a schematic top view of the scroll compressor.
Figure 8:
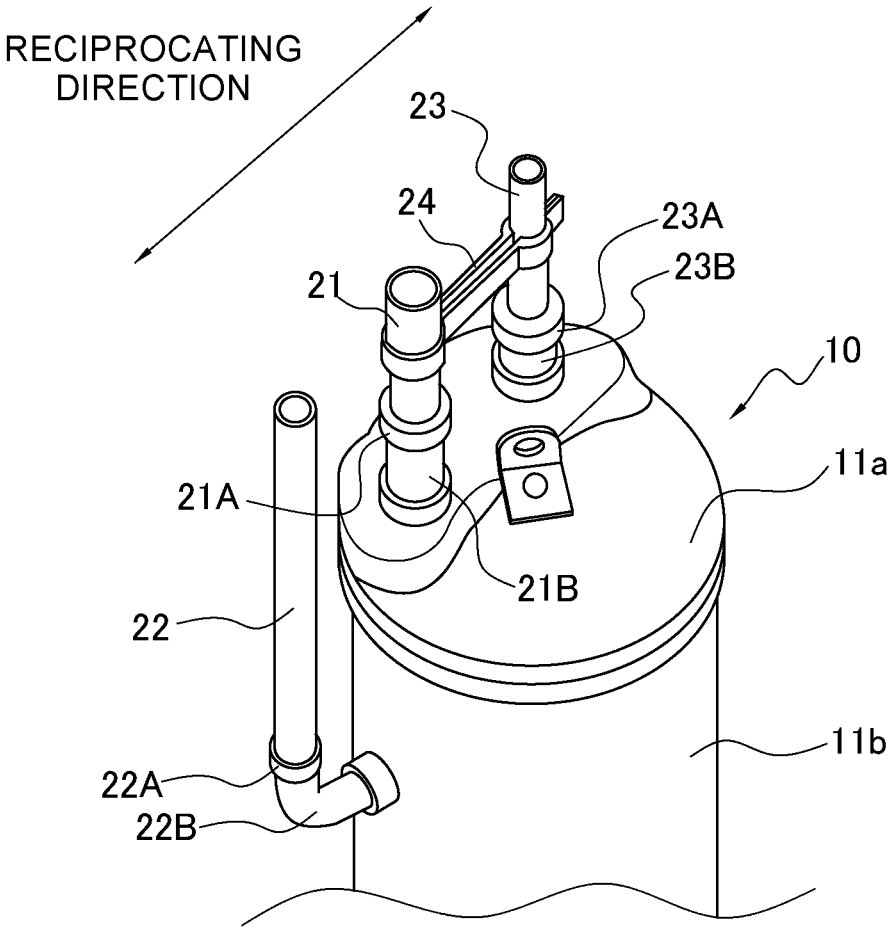
FIG. 8 is a schematic top view of the scroll compressor.
Figure 9:
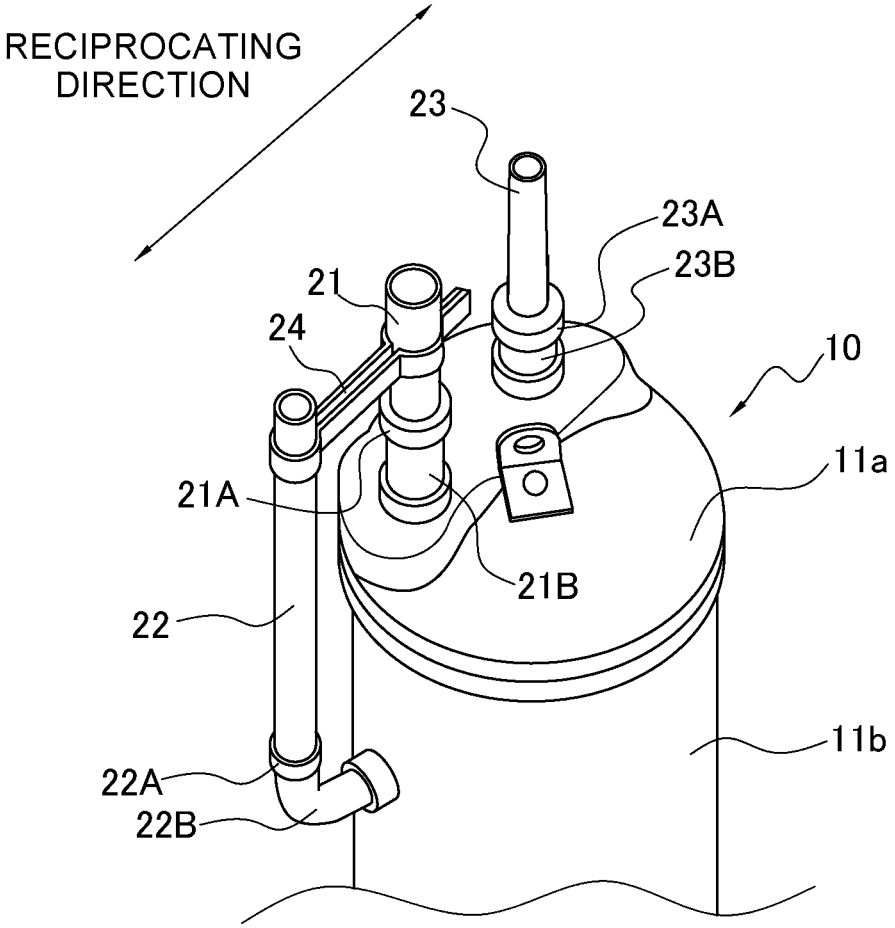
FIG. 9 is a schematic top view of the scroll compressor.

In the present disclosure, the pipe fixing member 24 fixes the suction pipe 21, the discharge pipe 22, and the injection pipe 23 extending vertically from the connection portions 21A, 22A, and 23A to each other. As a result, it is preferable to suppress vibration due to the unbalanced inertial force of the Oldham coupling 80. However, two of the three pipes 21, 22, or 23 may be fixed to each other by the pipe fixing member 24 as long as vibration of the scroll compressor 10 can be suppressed. Specifically, the pipe fixing member 24 may fix the discharge pipe 22 and the injection pipe 23 to each other as illustrated in FIG. 7, may fix the suction pipe 21 and the injection pipe 23 to each other as illustrated in FIG. 8, or may fix the discharge pipe 22 and the suction pipe 21 to each other as illustrated in FIG. 9.

Since the angle formed by the first straight line L1 in which the pipe fixing member 24 fixing two of the three pipes 21, 22, or 23 to each other extends in top view and the reciprocating direction of the Oldham coupling 80 is 10° or less, the vibration of the scroll compressor 10 can be suppressed. Note that the angle may be slightly shifted as long as the vibration of the scroll compressor 10 can be suppressed.

(5-2) Modification 2

In the present disclosure, the scroll compressor 10 includes the three pipes 21, 22, and 23 of the suction pipe 21, the discharge pipe 22, and the injection pipe 23. However, the disclosure described in the present disclosure can also be applied to the scroll compressor 10 not including the injection pipe 23.

Specifically, the scroll compressor 10 includes the suction pipe 21 and the discharge pipe 22, and the pipe fixing member 24 fixes the discharge pipe 22 and the suction pipe 21 to each other. This configured can effectively suppress the rigid body vibration of the scroll compressor 10 and improve the reliability of the scroll compressor 10.

(5-3) Modification 3

In the present disclosure, the scroll compressor 10 includes four support legs (legs) 13*b*. However, the disclosure can also be applied to the scroll compressor 10 including three support legs 13*b*.

Figure 10:
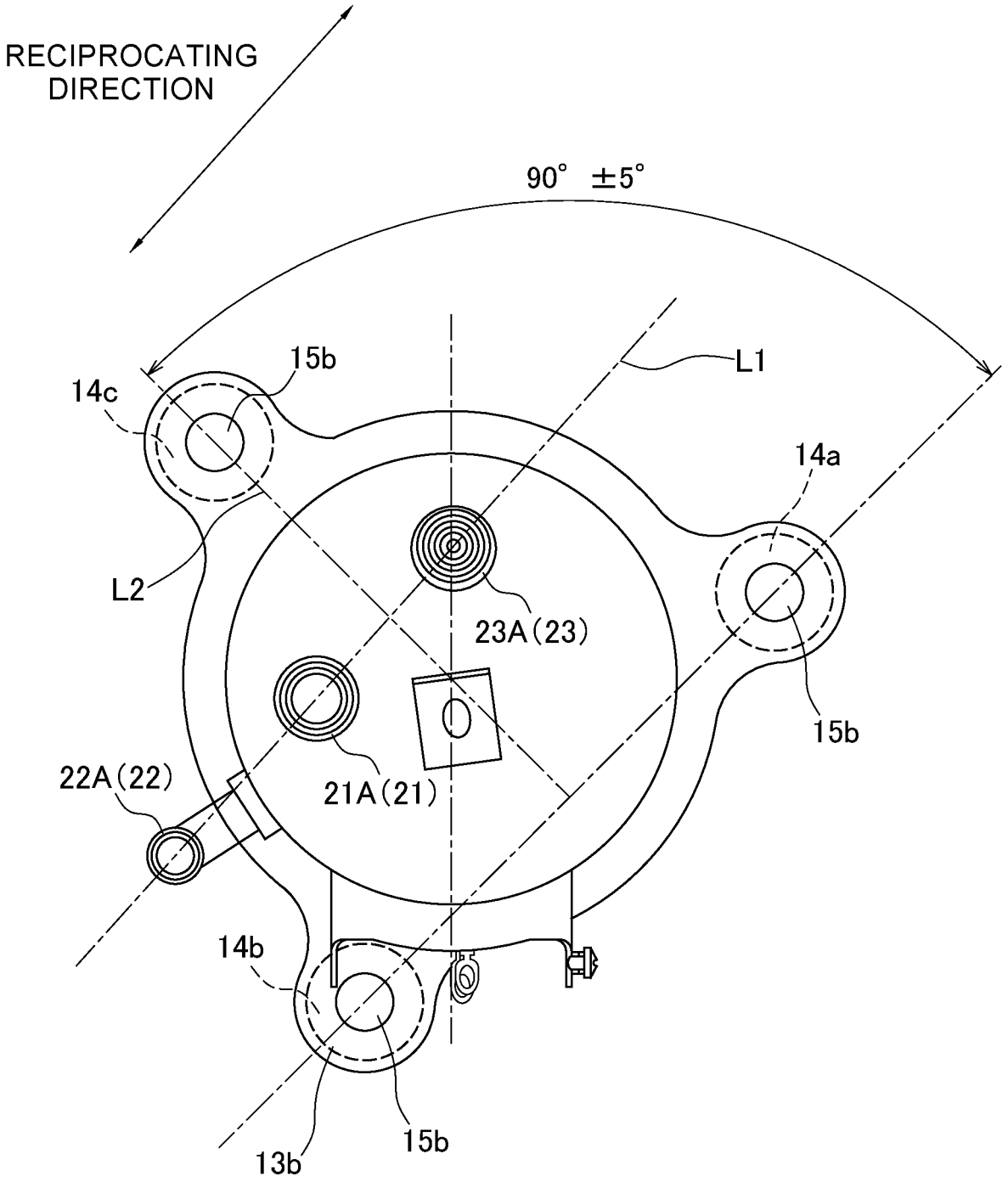
FIG. 10 is a schematic view of the scroll compressor.

Specifically, in the scroll compressor 10 including the three support legs 13*b* illustrated in FIG. 10, the support bracket 13 for fixing the casing 11 to the bottom plate 12 of the outdoor unit is provided below the casing 11. The support bracket 13 includes the support legs (legs) 13*b* each fixed to the bottom plate 12 via a vibration-proof member 14. Three support legs 13*b* are provided apart from each another in the circumferential direction of the casing 11.

The vibration-proof member 14 includes a cylindrical rubber material extending in the up-down direction. One of the three vibration-proof members 14 respectively attached to the support legs 13*b* is attached so as to exist on the second straight line L2 that passes through the center of the cylindrical member 11*b* of the casing 11, is orthogonal to the first straight line L1 which connects the pipes 21, 22, and 23. Here, orthogonal means that the second straight line L2 is preferably at an angle of 90°±5° with respect to the first straight line L1. The angle may be slightly shifted as long as the rigid body vibration of the scroll compressor 10 can be suppressed.

(5-4) Modification 4

In the present disclosure, the injection pipe 23 may include a silencer. Accordingly, noise generated in the heat source unit 3 can be suppressed.

(6)

The embodiment of the present disclosure has been described above. It will be understood that various changes to modes and details can be made without departing from the spirit and scope of the present disclosure recited in the claims.

The invention claimed is:

1. A heat source unit of a refrigerant cycle apparatus, the heat source unit comprising:

a suction pipe;

a discharge pipe;

an injection pipe; and a compressor connected to each of the suction pipe, the discharge pipe, and the injection pipe, at least two of the suction pipe, the discharge pipe, and the injection pipe including a vertical portion, the compressor including at least two of a first connection portion connecting the compressor to the vertical portion of the suction pipe, a second connection portion connecting the compressor to the vertical portion of the discharge pipe, and a third connection portion connecting the compressor to the vertical portion of the injection pipe, respectively, at least a part of the vertical portion of each of the at least two of the suction pipe, the discharge pipe, and the injection pipe extending vertically from each of the at least two of the first connection portion, the second connection portion, and the third connection portion, respectively, and a fixing member fixing the vertical portions of the at least two of the suction pipe, the discharge pipe, and the injection pipe, each of the at least two of the first connection portion, the second connection portion, and the third connection portion being located on a first straight line as seen in a top view of the compressor.

2. The heat source unit of the refrigerant cycle apparatus according to claim 1, wherein the compressor further includes a casing and three or four legs provided below the casing, and at least one of the legs is located on a second straight line that passes through a center of the casing and is orthogonal to the first straight line as seen in the top view.

3. The heat source unit of the refrigerant cycle apparatus according to claim 2, wherein each of the three or four legs is attached with a vibration-proof rubber.

4. The heat source unit of the refrigerant cycle apparatus according to claim 2, wherein a leg located at a position farthest from the first straight line among the three or four legs is attached with a vibration-proof rubber different from a vibration-proof rubber attached to the legs other than the leg located at the position farthest from the first straight line.

5. The heat source unit of the refrigerant cycle apparatus according to claim 1, wherein each of the suction pipe, the discharge pipe, and the injection pipe includes the vertical portion, and the compressor includes each of the first connection portion, the second connection portion, and the third connection portion, the first connection portion, the second connection portion, and the third connection portion are located on the first straight line as seen in the top view, and the fixing member fixes the suction pipe, the discharge pipe, and the injection pipe to each other.

6. The heat source unit of the refrigerant cycle apparatus according to claim 1, wherein the injection pipe includes a silencer.

7. The heat source unit of the refrigerant cycle apparatus according to claim 1, wherein the fixing member is made from metal.

8. A compressor comprising:

a casing to which two or three pipes of a suction pipe, a discharge pipe, and an injection pipe are fixed;

two or three connection portions of a first connection portion connecting the suction pipe, a second connection portion connecting the discharge pipe, and a third connection portion connecting the injection pipe; and three or four legs provided below the casing, wherein each of the connection portions is located on a first straight line as seen in a top view, and at least one of the legs is located on a second straight line that passes through a center of the casing and is orthogonal to the first straight line as seen in the top view.

9. A scroll compressor comprising:

two or three connection portions of a first connection portion connecting a suction pipe, a second connection portion connecting a discharge pipe, and a third connection portion connecting an injection pipe; and a scroll compression mechanism including a fixed scroll, a movable scroll, and an Oldham coupling, an angle of 10° or less being formed by a first straight line along which a pipe fixing member fixing two or three pipes of the suction pipe, the discharge pipe, and the injection pipe extends as seen in a top view and a reciprocating direction of the Oldham coupling.

10. A heat source unit including the scroll compressor according to claim 9, the heat source unit being part of a refrigerant cycle apparatus, the heat source unit further comprising:

a pipe fixing member, the suction pipe including a first vertical portion connected to the first connection portion, the discharge pipe including a second vertical portion connected to the second connection portion, the injection pipe including a third vertical portion connected to the third connection portion, and the pipe fixing member fixing two or three pipes of the suction pipe, the discharge pipe, and the injection pipe at the vertical portions.

11. The heat source unit of the refrigerant cycle apparatus according to claim 10, wherein the pipe fixing member fixes the discharge pipe and the injection pipe.

12. The heat source unit of the refrigerant cycle apparatus according to claim 10, wherein the pipe fixing member fixes the suction pipe and the injection pipe.

13. The heat source unit of the refrigerant cycle apparatus according to claim 10, wherein the pipe fixing member fixes the discharge pipe and the suction pipe.

14. The heat source unit of the refrigerant cycle apparatus according to claim 10, wherein the pipe fixing member fixes the suction pipe, the discharge pipe, and the injection pipe.

15. The heat source unit of the refrigerant cycle apparatus according to claim 10, wherein the pipe fixing member is made from metal.

* * * * *